United States Patent [19]

Uchida et al.

[11] 4,066,474

[45] Jan. 3, 1978

[54] METHOD OF MAKING HIGH STRENGTH COLD REDUCED STEEL BY CONTINUOUS ANNEALING PROCESS

[75] Inventors: Kuniki Uchida; Kenzi Araki, both of Yokohama; Shiro Fukunaka, Fukuyama; Takao Kurihara, Yokohama, all of Japan

[73] Assignee: Nippon Kokan Kabushiki Kaisha, Tokyo, Japan

[21] Appl. No.: 701,183

[22] Filed: June 30, 1976

Related U.S. Application Data

[63] Continuation of Ser. No. 545,027, June 30, 1976, abandoned.

[30] Foreign Application Priority Data

Jan. 31, 1974 Japan ..... 49-12187

[51] Int. Cl.[2] ..... B22D 25/00; C21D 1/00

[52] U.S. Cl. ..... 148/2; 75/123 R; 148/12 C; 148/143; 148/157

[58] Field of Search ..... 148/2, 3, 12 C, 12 D, 148/12 F, 12.3, 12.4, 143, 144, 157, 36; 25/123 D, 123 R

[56] References Cited

U.S. PATENT DOCUMENTS

| | | | |
|---|---|---|---|
| 2,095,580 | 10/1937 | Whetzel | 75/123 D |
| 3,615,926 | 10/1971 | Taylor | 148/143 |
| 3,806,376 | 4/1974 | Toda et al. | 148/12.3 |
| 3,821,031 | 6/1974 | Kubotera et al. | 148/2 |
| 3,827,924 | 8/1974 | Takechi et al. | 148/12 F |
| 3,839,095 | 10/1974 | Kubotera et al. | 148/12 C |
| 3,865,645 | 2/1975 | Takahashi et al. | 148/2 |
| 3,926,692 | 12/1975 | Ludwigson | 148/36 |

OTHER PUBLICATIONS

Special Report 79, Iron and Steel Institute, London, May 1963, pp. 87–92.

*Primary Examiner*—Walter R. Satterfield
*Attorney, Agent, or Firm*—Flynn & Frishauf

[57] ABSTRACT

A steel consisting essentially of 0.04 to 0.10% C, 0.04 to 0.20% P, not more than 0.02% S, and [S]% × 10 to 0.7% Mn is conventionally hot and cold rolled. It is then subjected to the following continuous annealing:

recrystallization heating step: $Ac_1$ to 900° C. × 10 to 120 sec.;

quenching step: starting temperature of quench: $Ac_1$ to 900° C.; quenching method: jet stream of water;

tempering quenched steel: 200° to 500° C. × 10 to 180 sec., and then conventional cooling and coiling. The steel has high tensile strength and excellent elongation and weldability characteristics.

4 Claims, No Drawings

METHOD OF MAKING HIGH STRENGTH COLD REDUCED STEEL BY CONTINUOUS ANNEALING PROCESS

RELATED APPLICATION

This application is a continuation of our application Ser. No. 545,027, filed June 30, 1976 and now abandoned.

The present invention relates to an improved method of making high strength cold reduced steel, and more in particular it offers a method for making steel having excellent mechanical properties including Lankford value of at least 1.1, ultimate tensile strength of 70 kg/mm$^2$ class, elongation of more than 20% thereon and cross tension strength of more than 900 kg/spot as spot weldability, by a continuous annealing process.

In recent years, demand for high strength cold reduced steel sheets is increasing in view of steps taken to improve safety of automobiles and similar vehicles. However, the research and development for this type of steel have not always been sufficient in response to the above demand. The present situation will be such that there is little effective or suitable means established. In viewing the situation prevailing today in the industry, it is found that the usual practice for making the above-mentioned high strength cold reduced steel is to add expensive elements such as Mn, Ti, Nb or V, and to anneal the steel in a batch type furnace. However, it is well known that such method is accompanied by the following defects, namely:

1: addition of expensive elements in a large amount causes an increase in costs,
2: cold reducing operation becomes difficult, and
3: non-uniformity in strength is unavoidable.

Aiming at elimination of the uneven strength and others, what is called BISRA type art (in U.K.) was proposed in Japanese Patent Publication No. 40-3020. This art teaches heating a steel strip of usual composition up to 740° to 850° C., quenching the same down to 150° to 250° C. and immediately coiling, and achieving over-aging effects by self-annealing as coiled. A large addition of C in order to obtain the necessary strength results in lowering elongation, spot weldability, Lankford value, stretch flanging property and in extremely insufficient drawability. Since self-annealing after coiling is utilized, the line is discontinued and impairs productivity thereby damaging its utility value. In addition, the art disclosed in Japanese Patent Publications No. 46-9541 and No. 46-9542 is different from that of No. 40-3020 and is an example of improved continuous annealing processes. The cold reduced steel strip is heated up to above $A_3$ and quenched in water to improve its strength. However, the art is quite defective in that the strength of the steel in the coating-baking stage after press forming is lowered by about 15 kg/mm$^2$. Because of the inferior elongation not improved in proportion to the increase in strength and the lower Lankford value, still inferior drawability and stretch flanging property remain as undesirable defects. Thus, the steel, which is hard at the time of press-forming and becomes soft after it is completed into a product, is very difficult to deal with and is, undoubtedly, not suitable as a product to meet the aforesaid demand.

The method of this invention has been developed to eliminate the various problems mentioned hereinabove. It is characterized first in that P in an amount of 0.04 to 0.20% is added and adjusted in the steel making stage.

This steel is then subjected to hot and cold rolling in conventional manner. In the following continuous annealing process, the steel is heated and held at $Ac_1$ — 900° C. for 10 to 120 seconds, quenched in a jet stream of water, subjected to tempering at 200° to 500° C. for 10 to 180 seconds, and finally cooled to room temperature and coiled.

An object of this invention is to provide a high strength cold reduced steel for keeping step to secure safety of vehicles by a continuous annealing process.

Another object of this invention is to provide a high strength cold reduced steel exhibiting increased initial strength of steel, at least the same level, in the following coating-baking stage after a required press-forming.

A further object of this invention is to provide a high strength cold reduced steel having good elongation, drawability, stretch flanging property and weldability in spite of increasing strength without addition of special elements.

Other objects and advantages of this invention will be apparent from the following description.

The manufacturing requirements of the present invention are as follows. In order to realize the full effect of the continuous annealing conditions based on this invention, a specific composition of the steel is necessary. The steel is fundamentally constituted of C: 0.04 to 0.10%, P: 0.04 to 0.20%,
S: not more than 0.02%, Mn: [S]% × 10 to 0.70%,
Balance: impurities and iron, further to which is added, if necessary, Si: 0.30 to 2.00%.

If necessary, Sol.Al. in the above two ranges is adjusted to be less than 0.010%. In a steel of such a low Sol.Al., still better drawability may be expected.

The processing requirements for a steel being made and adjusted withn the above ranges are as follows. There are no special restrictions laid on the various steps for obtaining the steel strip by cold reduction. For instance, such usual requirements as a finishing temperature of above 800° C. and a coiling temperature of 500° to 700° C. in the hot rolling stage will suffice. Ordinary conditions are applicable to cold rolling, namely, a cold reduction rate of about 70% for obtaining a cold reduced steel strip for drawing is deemed suitable. The following continuous annealing process should be controlled in the following manner in order to fully achieve the effects to be obtained with the above composition:

Recrystallization heating:
$Ac_1$ to 900° C. × 10 to 120 seconds,
Temperature at which quenching is started:
$Ac_1$ to 900° C.,
Quenching method:
Water quench in a jet stream,
Tempering temperature:
200° to 500° C. × 10 to 180 seconds,
Following cooling and coiling:
The usual manner.

These respective manufacturing requirements are indispensable for obtaining the following mechanical properties for a cold reduced steel having a strength of 40 to 80 kg/mm$^2$, Lankford value ($\bar{r}$): above 1.1,
Elongation (by JIS No. 5 test specimen):
40 kg/mm$^2$ material: more than 35%,
50 kg/mm$^2$ material: more than 30%,
60 kg/mm$^2$ material: more than 25%,
70 kg/mm$^2$ material: more than 20%, Sport weldability (cross tension strength — 1.2 mm thickness): more than 900 kg/spot.

The reasons for being limited as mentioned above are:

C: The lower limit of 0.04% is set at a critical value of the blowing operation by a converter on an industrial scale, while the upper limit of 0.10% is determined in view of Lankford value, elongation and spot weldability.

S: Since there is an undesirable influence in the coexistence of P and S on spot weldability, it is deemed that S should be as low as possible, at most 0.02% or less.

Mn: In view of the known red shortness of steel, the lower limit of [S]% × 10 is set, while the upper limit of 0.70% is set for the following reasons. Mn is essentially an element for forming austenite structure. Accordingly, the quenching structure in steel increases as Mn content is greater, thereby impairing drawability (*r* value). In this instance, Mn ≦ 0.20% is particularly preferable.

P: This is an element to be added beyond the range of an impurity in the present invention. Such an addition of P will cause improvement of Lankford value by synergistic effects obtained by the quenching treatment from $Ac_1$ to 900° C. with a jet stream of water. It is confirmed that this effect is particularly notable in steel to which more than 0.30% Si has been added. The reason for such a behavior is not known at the present stage, but this is the most remarkable effect that has been made clear first by the method of this invention. It is recognized that the sensitivity of a quenched temperature on a steel containing such an amount of P is lowered, which greatly contributes to uniformalizing quality of a material. This is assumedly on the basis that such an addition, which is one of ferrite-forming elements while Mn is one of austenite-forming elements, serves to reduce dependency of the heating temperature on an amount of "$\gamma$" in steel during recrystallization heating. Moreover, in a tempering treatment at a low temperature, it is discovered that the sensitivity of a tempering temperature bringing about a change of quality also is reduced on such a P-added steel. This also is one of the reasons for uniformalizing the quality of a material as well as the above-mentioned reducing of sensitivity of a quenching temperature. It is also found that the P-added steel improves elongation property. This is caused for the following reasons. Since P is an element showing a solution hardening behavior without increasing the amount of the second phase by quenching, it becomes possible to raise hardness of a ferrite phase without increasing hardness of quenching structure, thereby decreasing the difference of hardness between the ferrite phase and the second phase by quenching. Such a positive addition of P makes it possible to increase the strength of the steel at an extremely low cost, as well as providing many advantages. However, the effects of the present invention cannot be achieved by addition of less than 0.04% P. At the same time, addition of more than 0.20% P should be avoided lest spot weldability be impaired. The most preferable range is 0.05 to 0.120%.

Si: The present invention may achieve its purpose regardless of the presence of Si, but this element is used to adjust steel strength. Great significance of the present invention lies in the fact that steel strength can be adjusted without damaging the purposes and effects of this invention, particularly a Lankford value of above 1.1 as mentioned above. In other words, more than 0.3% Si can be added to the abovementioned basic composition without lowering the Lankford value; however, it is industrially limited to 2.0% at most.

Sol.Al: The purposes and effects of this invention are easily achieved independent of the amount of Sol.Al, but when it is limited to less than 0.010%, the effects are remarkable.

Hot and cold rolling requirements:

As mentioned above, there are no restrictions on these operations.

Continuous annealing requirements:

Recrystallization heating requirements.

At least $Ac_1$ should be secured as a recrystallization heating requirement for a cold reduced steel having the abovementioned composition. If the temperature is below $Ac_1$, it becomes difficult to obtain the required strength and brings about a decrease in Lankford value. Also, when it is above 900° C., the Lankford value as well as elongation is decreased. A holding time of less than 10 seconds at such a heating temperature will cause difficulties in securing recrystallization and of more than 120 seconds will lower line speed, i.e., its productivity, which is industrially undesirable.

Quenchng requirements:

The starting of the quench is from the above-mentioned recrystallization heating temperature. In order to quench a great amount of solute carbon and form quenching structure for improving strength, a temperature of at least $Ac_1$ is necessary. Starting from a temperature above 900° C. should be avoided, since the Lankford value and elongation are decreased remarkably. The heating cycle in accordance with the present invention is particularly characterized by quenching in a jet stream of water. This is based on a discovery and confirmation that the Lankford value is improved more as said quenching rate is used with steel strips consisting of the above composition. That is, a steel to which 0.04% to 0.20% P has been added will become a high strength cold reduced steel of more than 1.1 in its Lankford value only by quenching said steel in a jet stream of water from said temperature of $Ac_1$ to 900° C. If simple quenching into water or a metal bath, or rapid cooling by gas jetting method, were to be employed instead of quenching in the jet stream of water as mentioned above, the desired Lankford value cannot be obtained.

Tempering requirements at a low temperature:

In order to prevent lowering of strength at the baking-coating stage after press-forming by causing the solute carbon to precipitate up to a certain degree in the form of fine carbides, a tempering treatment of at least 200° C. × 10 seconds is required. However, when the tempering temperature exceeds 500° C., the lowering of strength by tempering becomes greater and that of the above-mentioned quenching effects also is brought about thereby.

However, when the tempering time exceeds 180 seconds, the line speed will slow down thus damaging productivity, which is industrially undesirable. The final cooling and coiling following this step are conducted in the usual manner.

Numerous experiments were carried out to make clearer the features and the utility of this invention process and its utility to a full extent. Representative examples thereby are shown below. The manufacturing requirements not disclosed in the Table are as follows.

Finishing temperature of hot rolling: 820 to 880° C.,
Final thickness by cold reducing: 0.8 mm,
Final thickness for spot welding: 1.2 mm,
Temper rolling rate: 0.8 to 1.5%, Heating rate in continuous annealing (including recrystallization heating and temper heating): 400 to 1,200° C./min.

| Steels | Object | Composition (%) C | P | S | Mn | Si | SolAl | Coiling Temp. (° C) | Cold reduction rate (%) |
|---|---|---|---|---|---|---|---|---|---|
| * 1 | Influence | 0.06 | 0.073 | 0.010 | 0.28 | tr | tr | 590 | 75 |
| 2 | of C | 0.12 | 0.081 | 0.009 | 0.23 | tr | tr | 595 | " |
| 3 | Influence | 0.09 | 0.011 | 0.009 | 0.32 | tr | tr | 600 | " |
| 4 | of P | 0.05 | 0.010 | 0.008 | 0.21 | 1.02 | 0.002 | 590 | " |
| * 5 | | 0.06 | 0.070 | 0.010 | 0.17 | 1.15 | 0.004 | 620 | " |
| * 6 | | 0.05 | 0.152 | 0.009 | 0.20 | 0.98 | 0.002 | 610 | " |
| 7 | | 0.05 | 0.238 | 0.006 | 0.25 | 0.95 | 0.007 | 610 | " |
| 8 | Influence | 0.05 | 0.082 | 0.025 | 0.25 | 0.77 | 0.003 | 630 | " |
| * 9 | of S | 0.06 | 0.075 | 0.016 | 0.24 | 0.83 | 0.005 | 620 | " |
| *10 | | 0.06 | 0.079 | 0.006 | 0.21 | 0.75 | 0.005 | 600 | " |
| 11 | Influence | 0.05 | 0.070 | 0.009 | 1.01 | 1.15 | 0.004 | 595 | " |
| *12 | of Mn | 0.04 | 0.088 | 0.007 | 0.33 | 1.03 | 0.004 | 620 | " |
| *13 | | 0.06 | 0.078 | 0.007 | 0.13 | 0.98 | 0.003 | 670 | " |
| *14 | Influence | 0.06 | 0.073 | 0.010 | 0.28 | tr | tr | 650 | " |
| *15 | of Si | 0.06 | 0.070 | 0.010 | 0.17 | 1.15 | 0.002 | 620 | " |
| *16 | Influence | 0.06 | 0.070 | 0.010 | 0.17 | 1.15 | 0.002 | 620 | " |
| *17 | of SolAl | 0.06 | 0.082 | 0.009 | 0.28 | 1.00 | 0.053 | 630 | " |

| Continuous annealing heat cycle: Heating and Soaking | Starting Temp. of quench | Quenching | Tempering | Mechanical properties TS(Kg/mm²) | El(%) | $\bar{r}$ | Spot weldability (Kg/spot) |
|---|---|---|---|---|---|---|---|
| 800° CX1min. | 790° C | Jet of | 250° CX1min. | 48.3 | 33.4 | 1.27 | 953 |
| " | " | water | " | 65.2 | 13.9 | 0.93 | 531 |
| " | " | " | " | 48.2 | 27.3 | 0.93 | — |
| 810° CX1min. | 800° C | " | 300° CX1min. | 58.0 | 27.0 | 0.97 | 959 |
| " | " | " | " | 59.5 | 29.6 | 1.22 | 1180 |
| " | " | " | " | 62.9 | 30.3 | 1.21 | 1005 |
| " | " | " | " | 63.9 | 29.9 | 1.22 | 621 |
| " | " | " | " | 57.3 | 30.1 | 1.21 | 713 |
| " | " | " | " | 56.9 | 30.5 | 1.19 | 932 |
| " | " | " | " | 58.7 | 29.9 | 1.20 | 1011 |
| " | " | " | " | 70.2 | 23.5 | 0.95 | — |
| " | " | " | " | 63.2 | 27.1 | 1.13 | — |
| " | " | " | " | 59.1 | 30.5 | 1.25 | — |
| " | " | " | " | 47.0 | 33.9 | 1.27 | 919 |
| " | " | " | " | 62.9 | 30.3 | 1.21 | 1005 |
| " | " | " | " | 62.9 | 30.3 | 1.21 | — |
| " | " | " | " | 62.1 | 25.5 | 1.10 | — |

| Steels | Object | Composition (%) C | P | S | Mn | Si | SolAl | Coiling Temp. (° C) | Cold reduction rate (%) |
|---|---|---|---|---|---|---|---|---|---|
| *18 | Influence | 0.06 | 0.070 | 0.010 | 0.17 | 1.15 | 0.004 | 600 | 65 |
| *19 | of cold | " | " | " | " | " | " | 620 | 75 |
| *20 | | " | " | " | " | " | " | 680 | 85 |
| 21 | Influence | " | " | " | " | " | " | 620 | 75 |
| *22 | of temp. | " | " | " | " | " | " | " | " |
| *23 | and start- | " | " | " | " | " | " | " | " |
| 24 | ing temp. of quench | " | " | " | " | " | " | " | " |
| *25 | Influence | " | " | " | " | " | " | " | " |
| 26 | of quenching method | " | " | " | " | " | " | " | " |
| 27 | Influence | " | " | " | " | " | " | " | " |
| 28 | of temper- | " | " | " | " | " | " | " | " |
| *29 | ing temp. | " | " | " | " | " | " | " | " |
| *30 | | " | " | " | " | " | " | " | " |
| 31 | | " | " | " | " | " | " | " | " |
| 32 | Annealing | " | " | " | " | " | " | " | " |
| 33 | process | " | " | " | " | " | " | " | " |
| 34 | | " | " | " | " | " | " | " | " |
| *35 | | " | " | " | " | " | " | " | " |

| Continuous annealing heat cycle: Heating and soaking | Starting Temp. of quench | Quenching | Tempering | Mechanical properties TS(Kg/mm²) | El(%) | $\bar{r}$ | Spot weldability (Kg/spot) |
|---|---|---|---|---|---|---|---|
| 810° CX1min. | 800° C | Jet of | 300° CX1min. | 58.3 | 29.9 | 1.15 | — |
| " | " | water | " | 59.5 | 29.6 | 1.22 | — |
| " | " | " | " | 60.4 | 29.0 | 1.30 | — |
| 920° CX1min. | 920° C | " | " | 67.4 | 16.9 | 0.92 | — |
| 810° CX1min. | 800° C | " | " | 59.5 | 29.6 | 1.22 | — |
| 750° CX1min. | 740° C | " | " | 57.9 | 31.0 | 1.21 | — |
| 700° CX1min. | 690° C | " | " | 53.3 | 31.2 | 0.88 | — |
| 810° CX1min. | 800° C | " | " | 59.5 | 29.6 | 1.22 | — |
| " | " | Jet of gas | " | 50.9 | 31.0 | 0.95 | — |
| " | " | jet of | — | 69.8 | 19.2 | 1.18 | — |
| " | " | water | 150° CX1min. | 65.2 | 23.3 | 1.22 | — |
| " | " | " | 350° CX1min. | 57.5 | 29.6 | 1.22 | — |
| " | " | " | 400° CX1min. | 55.5 | 31.2 | 1.20 | — |
| " | " | " | 600° CXlmin. | 51.2 | 30.8 | 1.23 | — |
| 700° CX3hr. | — | — | — | 47.8 | 35.5 | 1.20 | — |
| 710° CX1min. | 710° C | Air cooling | — | 52.3 | 30.2 | 0.83 | — |

-continued

| | | | | | | | |
|---|---|---|---|---|---|---|---|
| 810° CX1min. | 800° C | " | " | 50.0 | 33.3 | 0.95 | — |
| " | " | Jet of water | 300° CX1min. | 59.5 | 29.6 | 1.22 | — |

(*The invention steels)

In the above Table, Steels 1 and 2 are examples among many steels which were studied in respect of C content. Steel 1, illustrating the invention, shows a value exceeding the desired values in strength as well as "$\bar{r}$", "El" or spot weldability. However, comparative Steel 2 shows values radically below the desired values in spite of the fact that only C content is different from the specified steel composition and that the same manufacturing requirements were employed. This indicates that C content should be adjusted to the C range of this invention.

Effect of P content was studied in Steels 3 to 7. The composition of Steel 3 was adjusted so that its tensile strength would become 45 kg/mm$^2$ without the addition of P. Its $\bar{r}$ value was found to be far below the desired value, i.e., 0.93. When compared to Steel 1, effects of P addition are self-explanatory. Effect of P addition in 1.0% Si system steels was investigated in respect of Steels 4 to 7. Comparative Steel 4 with low P content shows a $\bar{r}$ value of 0.97, displaying the fact that it does not achieve the desired value even when subjected to the same manufacturing requirements. On the contrary, comparative Steel 7, to which P exceeding the upper limit of the present invention was added, shows an exceedingly lower value in said spot weldability with 621 kg/spot, and is defective in its utility. Whereas, Steels 5 and 6 illustrating the invention show values exceeding those of the ordinary batch type annealed steels in respective properties. When the range is adjusted optimumly, P-addition helps the steel to fully exert its novel effects along with the synergistic effects of the heating cycles in a continuous annealing process.

Steels 8 to 10 were studied in respect of the effect of S content in steel. As has been discussed already, S content in steel exerts great influence on its spot weldability. Comparative Steel 8 contains 0.025% S, far exceeding the upper limit of the present invention, and its spot weldability is 713 kg/spot, which is lower than the desired value. On the other hand, Steel 9, illustrating the invention, contains 0.016% S and has a 932 kg/spot value, far exceeding the desired value; while Steel 10, also illustrating the invention, contains 0.006% S and shows a high spot weldability of 1,011 kg/spot. This suggests that S content should be regulated as low as possible, at a maximum 0.02% S.

Steels 11 to 13 were studied in respect of Mn effect. This is mainly manifested in Lankford value. Comparative Steel 11 containing 1.01% Mn shows a $\bar{r}$ value of 0.95, a value lower than the desired value. However, Steel 12 in which Mn content is within the optimum range has a value of 1.13, far exceeding the desired value. Steel 13 containing only 0.13% of Mn has an excellent $\bar{r}$ value of 1.25. Steels 12 and 13 illustrate the invention.

Steels 14 and 15 were investigated in respect of Si effect in particular. Both illustrate the invention, but the former is an example where Si addition is not made positively, i.e., an ordinary content, while the latter contains 1.15% Si.

Upon comparison of the two steels, it is found that Steel 14 has a strength similar to that of Steel 1 where no Si addition was made and Steel 15 shows a radical increase in strength. In spite of the increase in Si content, other desired values such as in drawability, elongation and spot weldability do not decrease particularly. This is where the significance of Si's role in the present invention is eloquently displayed.

Steels 16 and 17 were studied in respect of the effects of Sol.Al. Both illustrate the invention, and Steel 16 which contains only 0.002% Sol.Al. particularly shows a high $\bar{r}$ value of 1.21, thus indicating that lower Sol.Al. content is more advantageous for $\bar{r}$ value.

Steels 19 to 20 were studied in respect of the effect by cold reduction rate. Although these three illustrate the invention, their $\bar{r}$ values are found on an upward curve as their reduction rate is increased.

Steels 21 to 24 were studied in respect of recrystallization heating and a starting quench temperature in the continuous annealing process. In a continuous annealing operation by the method of this invention, a holding time at recrystallization heating is short and temper-treating is achieved quickly, which required simultaneous study of the two factors, since separating the two was extremely difficult. According to the investigations made, it is ascertained that $\bar{r}$ value of the comparative steel which belongs to the same composition type as the present invention is extremely low at 0.88, since the temperature at which quenching is started did not reach the $A_1$ point, and similarly $\bar{r}$ value of comparative Steel 21 which started quenching at 920° C. and was heated exceeding that of this invention, also is very low at 0.92 in addition to the extremely low elongation value of 16.9%. Thus, they should be avoided. Whereas, Steels 22 and 23 (illustrating the invention) for which the temperature is within the optimum range of this invention showed satisfactory properties, namely values beyond the desired values.

Steels 25 and 26 were investigated in respect of the effect of the quenching method. Comparative Steel 26, which is within the range of the optimum composition but which has been subjected to a slower quenching rate with a gas jetting method, had a low $\bar{r}$ value of 0.95. Whereas, the $\bar{r}$ value of Steel 25 illustrating the invention which was quenched in a jet stream of water with sufficient cooling rate reached as high as 1.22. The utility of the jet stream of water in accordance with the present invention is more than sufficiently explained by a remarkable difference in the $\bar{r}$ value, particularly since the compositions are the same. This naturally is attributable to the synergistic effect between the quenching method and the above-mentioned composition.

Steels 27 and 31 were investigated in respect of tempering temperature. Comparative Steel 27 was not subjected to any tempering treatment. The steel showed a lowering of strength by about 6.0 kg/cm$^2$ in a coating-baking stage of 170° C. × 30 minutes. Steel 28 was subjectd to a tempering treatment at 150° C., which is lower than the present invention's optimum range, resulting in lowering of 2.0 kg/cm$^2$ in strength after baking.

It is naturally true that such steels of which respective strength is lowered by the baking treatment are not suitable for use as high strength cold reduced steels. On the other hand, Steels 29 and 30, which were subjected to an optimum temper-treatment within the range of this invention, display well balanced properties as indicated in the Table and show no lowering of strength after baking. However, a tempering temperature for comparative Steel 31 is high at 600° C. and accordingly shows a lower value of 51.2 kg/cm² in strength which is 5–9 kg/cm² lower than that of steels illustrating this invention. Thus, it becomes clear that the temper-treatment should be carried out optimumly in order to obtain a high strength cold reduced steel which maintains the necessary strength and does not cause a decrease in strength in the baking stage.

Steels 32–35 were studied in respect of effects by various annealing methods. Comparative Steel 32 was subjected to an ordinary batch type annealing, i.e., soaking at 700° C. for 3 hours and gradual cooling as in a coil. This steel had a strength lower by 11 kg/cm² than that of Steel 35 illustrating the present invention, although of the same composition. In addition, the productivity as well as uniformity of material quality for the former are far inferior to those of the latter, since the former is produced in batch-type annealing with a coil form while the latter is continuously annealed with a strand form. Comparative Steel 33 is shown as an example made by an ordinary continuous annealing process. The strength thereof is far lower than illustrative Steel 35 having a 52.3 kg/cm² value therein and $\bar{r}$ value is also extremely low at 0.83. On the other hand, another comparative Steel 34 was subjected to a heating temperature of 810° C. higher than that of Steel 33. Consequently, it had a somewhat improved $\bar{r}$ value, but is far inferior to that of illustrative Steel 35 in strength or $\bar{r}$ value.

We claim:

1. In a method of making a high strength cold reduced steel with a continuous annealing process, the improvement which comprises:

maintaining the chemical composition of the steel in the steel making stage within the following ranges:

C: 0.04 to 0.10%,
P: 0.04 to 0.20%,
S: not more than 0.02%,
Mn: [S]% × 10 to 0.70%,
balance: Fe and impurities;

hot rolling and cold reducing the steel, and subjecting the resulting cold reduced steel to a continuous annealing process comprising the following heat cycle:

i. heating the resulting cold reduced steel to and maintaining the heated steel at a temperature of from $Ac_1$ to 900° C. for from 10 to 120 seconds,
ii. quenching the steel of (i) which is at a temperature of from $Ac_1$ to 900° C. with a jet stream of water,
iii. tempering the quenched steel at a temperature of from 200° C. to 500° C. for from 10 to 180 seconds, and
iv. cooling and coiling the tempered steel, the steel so obtained having a Lankford value of at least 1.1, tensile strength of from 40 to 80 kg/mm², elongation of more than 20% and spot weldability of more than 900 kg/spot.

2. The method of claim 1, wherein the chemical composition in the steel making stage consists essentially of, in percent by weight:

carbon: 0.04 to 0.10
phosphorus: 0.04 to 0.20
silicon: 0.30 to 2.00
sulfur: not more than 0.02
manganese: [S] × 10 to 0.7
iron and impurities: balance.

3. The method of claim 1, wherein the chemical composition contains Sol Al in an amount up to 0.010% in the steel making stage.

4. The method of claim 2, wherein the chemical composition contains Sol Al in an amount up to 0.010% in the steel making stage.

* * * * *

UNITED STATES PATENT AND TRADEMARK OFFICE

CERTIFICATE OF CORRECTION

PATENT NO. : 4,066,474

DATED : January 3, 1978

INVENTOR(S) : KUNIKI UCHIDA et al

It is certified that error appears in the above-identified patent and that said Letters Patent are hereby corrected as shown below:

Title page, at "[63]": after "545,027", replace "June 30, 1976" with ---January 29, 1975---.

Column 1, line 8: replace "June 30, 1976" with ---January 29, 1975---.

Column 2, line 36: replace "withn" with ---within---.

Column 3, line 1: replace "Sport" with ---Spot---.

Column 3, line 17: replace "(r" with ---($\bar{r}$---.

Columns 5-6, third table, second column: after "Influence of cold", insert ---reduction---.

Column 8, line 33: replace "$A_1$" with ---$Ac_1$---.

Signed and Sealed this

*Twelfth* Day of *December 1978*

[SEAL]

*Attest:*

RUTH C. MASON
*Attesting Officer*

DONALD W. BANNER
*Commissioner of Patents and Trademarks*